United States Patent [19]

Buchholz et al.

[11] 4,231,727

[45] Nov. 4, 1980

[54] VACUUM PRODUCING ROTARY VANE PUMP WITH SHAFT LUBRICATION

[75] Inventors: Peter Buchholz; Rolf Warnecke, both of Gifhorn; Alfred Beier, Brunswick, all of Fed. Rep. of Germany

[73] Assignee: Volkswagenwerk Aktiengesellschaft, Fed. Rep. of Germany

[21] Appl. No.: 811,172

[22] Filed: Jun. 29, 1977

[30] Foreign Application Priority Data

Jul. 10, 1976 [DE] Fed. Rep. of Germany ..... 2631152

[51] Int. Cl.[3] ..... F04C 29/00; F04C 25/00

[52] U.S. Cl. ..... 418/76; 418/82; 418/93; 418/152

[58] Field of Search ..... 418/75, 76, 77, 82, 418/93, 102, 152

[56] References Cited

U.S. PATENT DOCUMENTS

| | | | |
|---|---|---|---|
| 1,270,872 | 7/1918 | Roberts et al. | 418/82 X |
| 2,022,610 | 11/1935 | Wendell | 418/77 |
| 2,481,143 | 9/1959 | Muller | 418/102 |
| 2,737,341 | 3/1956 | Bitzer | 418/76 X |
| 2,903,971 | 9/1959 | Collins | 418/152 X |
| 3,169,696 | 2/1965 | Warner | 418/93 X |
| 3,258,198 | 6/1966 | Harlin | 418/93 |
| 3,312,387 | 4/1967 | Cassidy et al. | 418/93 X |
| 3,622,254 | 11/1971 | LeBlanc, Jr. | 418/179 X |

*Primary Examiner*—Leonard E. Smith
*Attorney, Agent, or Firm*—Brumbaugh, Graves, Donohue & Raymond

[57] ABSTRACT

A rotary vacuum pump is provided with a housing having a cylindrical chamber. A rotor having a plurality of slideably mounted vanes is mounted within the chamber by a shaft extending through an eccentric bore. Hydraulic oil delivered to the rotor under pressure urges the vanes against the chamber walls. Escaping oil lubricates and seals the vanes and also lubricate the rotor shaft.

16 Claims, 10 Drawing Figures

VACUUM PRODUCING ROTARY VANE PUMP WITH SHAFT LUBRICATION

BACKGROUND OF THE INVENTION

This invention relates to rotary vacuum pumps and particularly to rotary vacuum pumps having moveable vanes mounted to a rotor which is eccentrically mounted in a cylindrical chamber.

Rotary pumps of the general type disclosed are commonly used for fluid pumping and pressure generating applications. In particular, such rotary pumps are useful in generating vacuum pressure in a motor vehicle for operation of auxiliary equipment, such as power brakes. In many engines, vacuum pressure is directly available from the engine intake manifold. In other cases, diesel engines in particular, it is necessary to provide an auxiliary vacuum pump for operation of auxiliary equipment.

It is an object of the invention to provide a simple inexpensive and reliable rotary pump having a high volume capacity.

SUMMARY OF THE INVENTION

In accordance with the invention, there is provided a rotary vacuum pump, including a cast housing with a cylindrical chamber, and a rotor in the chamber having a cylindrical case-hardened shaft extending vertically through a plane bore in the housing parallel and eccentric to the chamber. The rotor has a plurality of slideably mounted vanes which are urged against the cylindrical chamber walls by hydraulic oil pressure, forming variable volume pump chambers between the vanes. A part of hydraulic oil escapes into the cylindrical chamber promoting sealing between the vanes and the walls of the cylindrical chamber. The housing is provided with a groove extending along the bore and opening into the cylindrical chamber for the return of escaped hydraulic oil and for providing the oil to the shaft.

The edge of the oil return groove is advantageously broken to promote the forming of a lubricating oil film between the shaft and the bore. The rotor may be fabricated from sintered material and press-fitted onto a knurled section of the shaft. A smooth shaft end-section may be provided for guiding the press-fitting operation during rotor assembly. The pump is advantageously mounted directly to an engine crankcase so that the shaft projects into the crankcase and therein engages an engine shaft. The oil return groove thereby opens directly into the crankcase. The suction opening and hydraulic oil delivery opening of the pump are advantageously located in an end cover mounted to the housing. A blind hole on the rotor can be used to conduct hydraulic oil from the oil delivery opening to slots in the rotor behind the vanes. When the pump is mounted to an engine and engaged to an engine shaft by a bevel gear, the rotor ends are preferably chamfered at the slot edges to promote the formation of a lubricating oil film between the rotor end and housing. In an alternate embodiment, lubricating oil may be supplied from the cylindrical chamber to the shaft by a pocket-shaped depression in the housing at one end of the cylindrical chamber.

For a better understanding of the present invention, together with other and further objects, reference is made to the following description, taken in conjunction with the accompanying drawings, and its scope will be pointed out in the appended claims.

DESCRIPTION OF THE INVENTION

Figure 1:
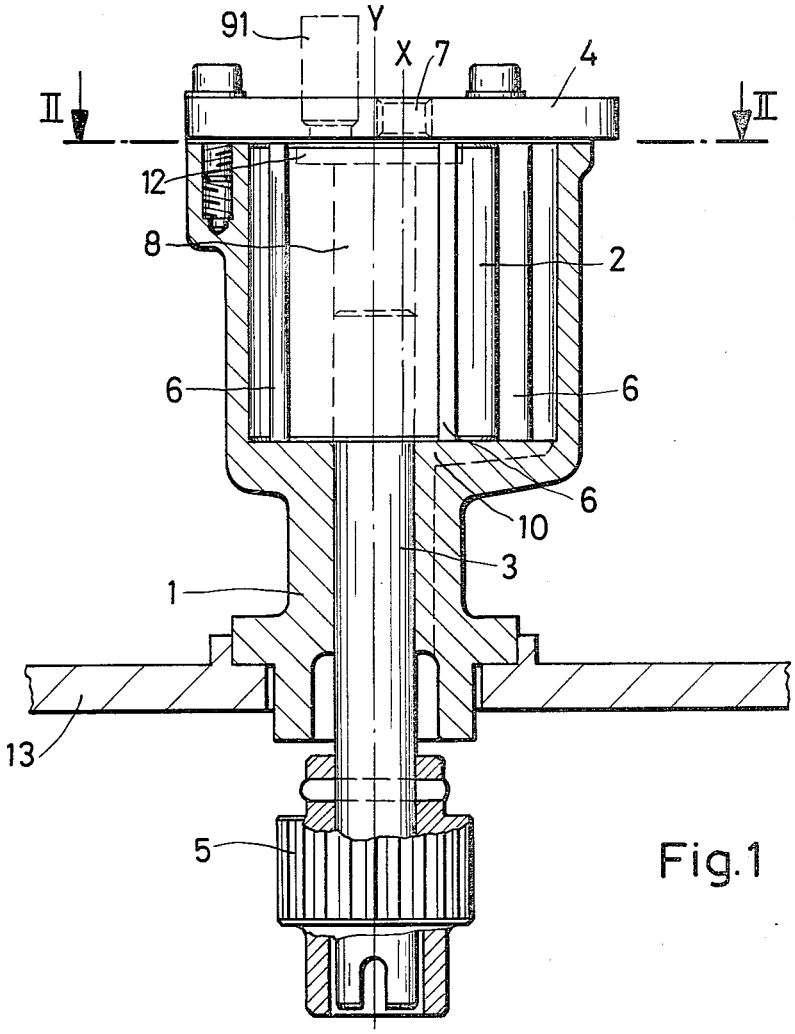
FIG. 1 is a longitudinal cross-section of a rotary pump in accordance with the invention.
Figure 2:
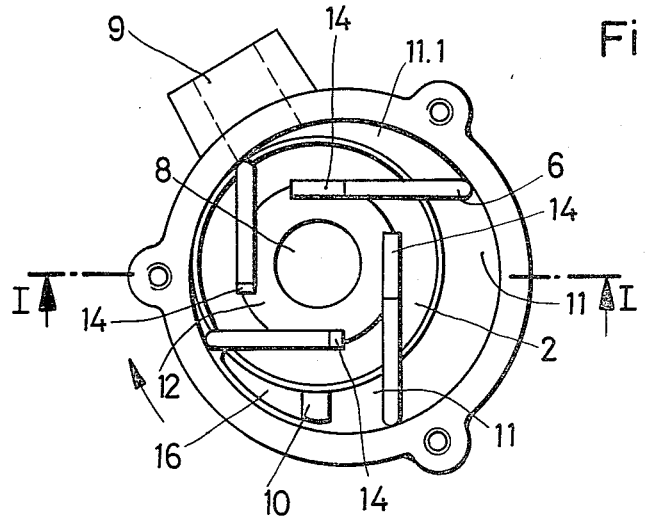
FIG. 2 is an end view of the FIG. 1 pump, with the top cover removed.

FIGS. 1 through 6 generally illustrate a rotary pump in accordance with the invention. The pump includes a housing 1, which is provided with a cylindrical chamber within which there is mounted a rotor 2. Rotor 2 is provided with a shaft 3 which extends through a bore 15 in housing 1. Bore 15 is parallel and eccentric with respect to the cylindrical housing chamber. The axis of bore 15, indicated as Y in FIG. 1 is therefore displaced from the cylindrical chamber axis, indicated by X. Rotor 2 is provided with slideably mounted vanes 6 which are urged into sealing contact with the walls of the cylindrical chamber by hydraulic oil pressure acting in tangential slots 14 within which the vanes move. Hydraulic oil is supplied to slots 14 by connection 7 in housing cover 4, which communicates with blind hole 12 in rotor 2. Rotor 2 and flaps 6 have approximately the same length as the cylindrical chamber so that individual pump chambers 11, between the vanes, are sealed from each other.

As a result of the offset of bore 15 within which rotor shaft 3 is mounted, the rotor vanes 6 move in and out of their respective slots 14 as the rotor is rotated about its shaft. Pump chambers 11 are formed by the adjacent vanes 6 of rotor 2. Because of the eccentric arrangement, the volume of these chambers varies as the rotor is rotated. For example, volume of chamber 11.1 in FIG. 2 increases from zero to the maximum value shown in FIG. 2 when the rotor is rotated in the direction indicated by the arrow.

As a result of its increasing volume, there arises a vacuum pressure in chamber 11.1, which may be taken off by a suction opening 9 in the side wall of the casting-housing 1, which is in communication with the pump chamber 11.1 between vanes 6, for generating vacuum pressure in a motor vehicle, useful for operation of power brakes.

In order to provide lubrication and sealing of the rotor vanes to the inner walls of the cylindrical chamber in housing 1, a selected amount of the hydraulic oil in slots 14 is permitted to leak past vanes 6 and enter the cylindrical chamber. This oil provides lubrication and promotes sealing between the rotor vanes 6 and the chamber walls.

Figure 5:
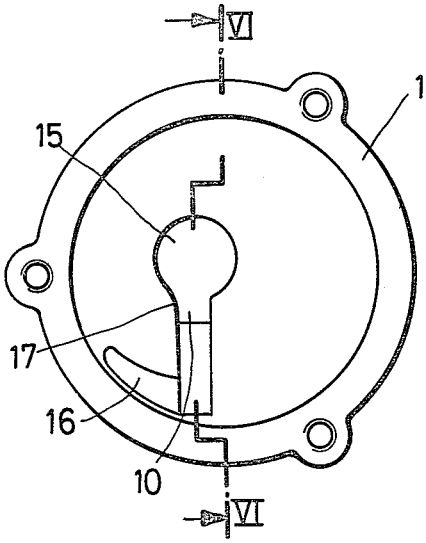
FIG. 5 is an end view of the FIG. 1 pump housing.
Figure 6:
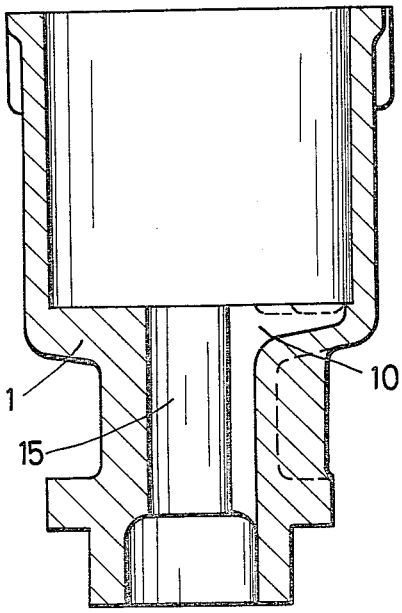
FIG. 6 is a cross-sectional view of the housing of FIG. 5.

A groove 10, which runs along bore 15 in housing 1 is provided to drain off excess oil from the cylindrical chamber. Groove 10 is arranged starting in the housing floor in the last sliver of space between rotor 2 and the housing wall and carries off the oil as the vanes are thrust inward. Groove 10 also allows the outflow of pressure from the pump. The oil flowing through groove 10 comes into communication with shaft 3 in bore 15 and provides a lubricating film on the shaft. This arrangement of groove 10 running along shaft 3 eliminates the need for bearings or seals associated with the shaft. A case-hardened shaft may be mounted directly within a bore in cast housing 1, and by reason of the lubrication provided by oil flowing back along groove 10, a film is formed on shaft 3 which adequately lubricates the pump shaft. A depression 16 communicating with groove 10 assures effective flow of excess oil into the groove and may also provide an outlet conduit for air in pump chambers 11 when the rotary pump is being used as a suction booster. The leading edge 17 of groove 10 may be broken by being beveled or rounded, as shown in FIG. 5, to promote the formation of a lubricating film on the shaft.

The rotary pump of the present invention is easily adapted for use as a vacuum pump in connection with an automobile engine as mentioned above. Where the automobile engine is a diesel engine manufactured with common engine block component parts as a gasoline engine, the pump of the present invention can be mounted to the crankcase of the diesel engine in place of the distributor used in the gasoline engine. This crankcase mounting is illustrated in FIG. 1, which shows only a portion 13 of the crankcase cover. A beveled worm gear or gear pinion 5 may be provided on shaft 3 for engaging one of the engine shafts, such as an intermediate shaft on cam shaft, to drive the pump. When mounting to a motor vehicle engine, excess oil flowing along groove 10 can be permitted to drain directly into the crankcase. In other mounting arrangements, groove 10 will lead to a special oil return connection. In such an installation, hydraulic oil may be provided to inlet 7 from the pressurized lubricating system of the engine. A pressure reducing valve may be required between the oil pump and the oil inlet 7.

Shown by dotted lines in FIG. 1 is an alternate configuration for the suction opening. A suction opening 91 may be provided in the cover plate 4 along with an oil delivery opening 7. Opening 91 must naturally communicate with the same sliver of space between the wall and the rotor as opening 9. This arrangement for the suction and oil delivery openings facilitates pump manufacture, since housing 1 and cover 4 are provided only with bores parallel to the axis of the rotor and the cylindrical chamber.

Figure 7:
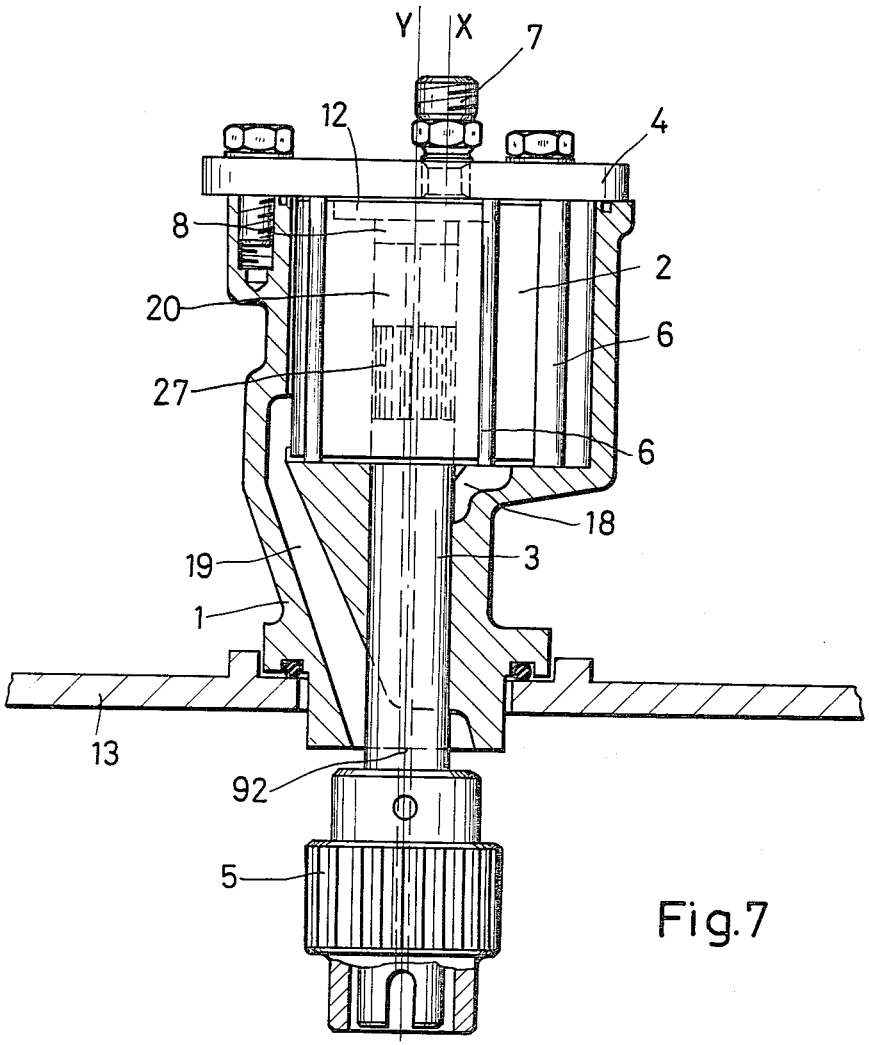
FIG. 7 is a longitudinal cross-section view of another rotary pump in accordance with the invention.

As an alternate to oil delivery opening 7 on the cover plate 4, the pump may have a passage 92 shown in FIG. 7 located at the center of shaft 3 for providing hydraulic oil to blind hole 12 and slots 14. The oil inlet passage in shaft 3 eliminates the need for an external oil pressure line communicating with inlet 7.

Figure 3:
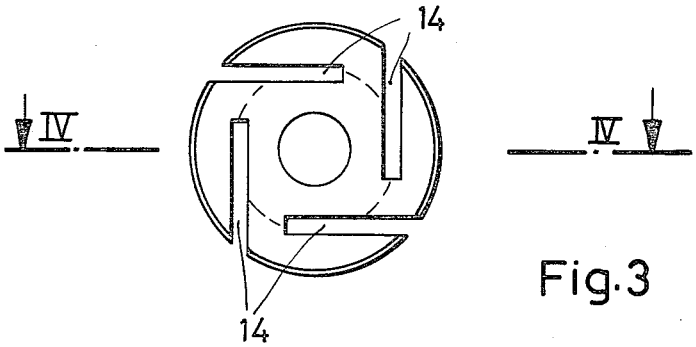
FIG. 3 is an end view of the rotor for the FIG. 1 pump.
Figure 4:
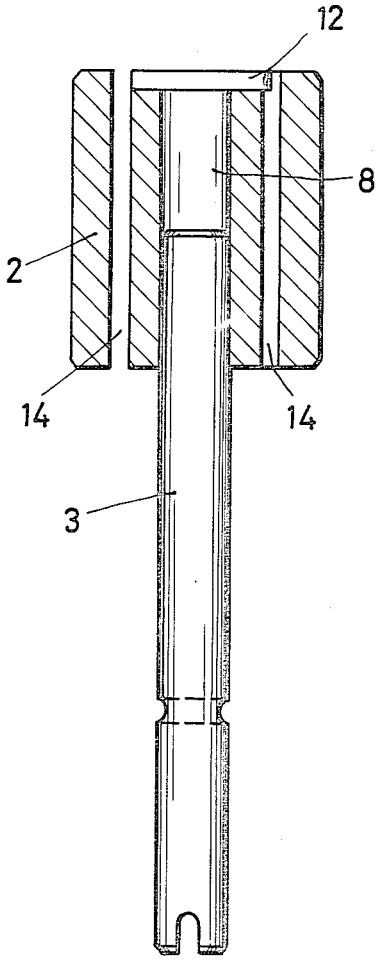
FIG. 4 is a longitudinal cross-section of the FIG. 3 rotor.

FIGS. 3 and 4 illustrate the rotor assembly of the FIG. 1 pump. The rotor body is provided with tangential slots 14 for receiving flaps 6 and has a central bore 8 for receiving shaft 3. Shaft 3 is case-hardened steel and preferably press-fitted into bore 8 on rotor 2. The rotor body can be fabricated from metal with machined slots. The rotor body could also be made from synthetic material with case-in slots.

Figure 9:
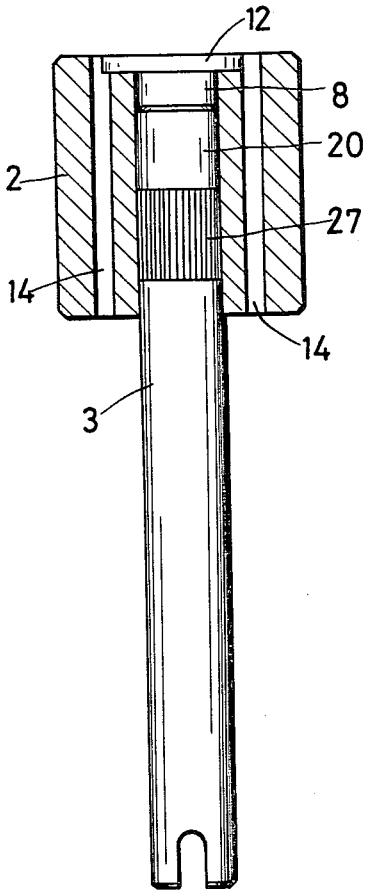
FIG. 9 is a cross-sectional view of the FIG. 8 rotor.

Special advantages are gained if rotor 2 is made from sintered material since the complex shape can easily be produced with close tolerances. Usually sintered material is not suited for press-fitting because, although its compression strength is high, its tensile or shearing strength is low. When sintered material is used for the rotor, assembly without rotor damage is facilitated by knurling a portion 27 of shaft 3 as illustrated in FIG. 9. The knurling yields upon engagement of the parts to provide a solid assembly because of the interference fit betwee rotor 2 and shaft 3 without excess tensile or shearing forces. An end portion 20 of shaft 3 may be left in a smooth condition, having a smaller diameter than the knurled portion, to guide and align rotor 2 with shaft 3 prior to the pressing operation. This prevents rotor damage and assures excellent alignment and parallelism between the rotor and the shaft, promoting a proper seal with the ends of the cylindrical chamber.

Figure 8:
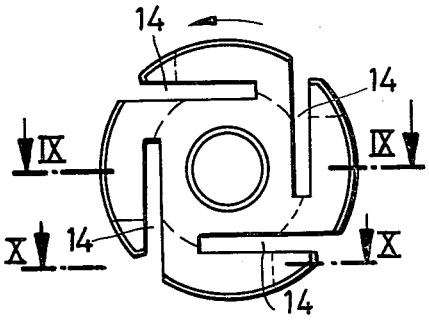
FIG. 8 is an end view of a rotor useable with the FIG. 7 pump.
Figure 10:
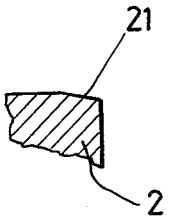
FIG. 10 is a partial cross-sectional view of the FIG. 8 rotor.

When a worm or pinion gear 5 coupled to an engine shaft is used to rotate shaft 3, depending on the helix angle of gear 5, there may result an axial force on shaft 3 tending to force rotor 2 against one of the axial ends of the cylindrical chamber. This force may tend to eliminate the lubricating film between rotor 2 and housing 1, or between rotor 2 and cover plate 4. To prevent the elimination of the lubricating film and possible damage to the moving parts, the leading edge of rotor 2 adjoining each slot 14 may be provided with a wedge-shaped chamfer 21 illustrated in FIGS. 8 and 10. This leading edge chamfer is most useful at whatever end of rotor 2 is subjected to axial compression against the housing or cover, but may be provided at both ends of rotor 2, especially when the rotor may be subjected to axial forces in either direction. The leading edge chamfer forces oil between the rotor and housing while the pump is running thus assuring lubrication.

FIG. 7 is a cross-sectional view of an alternate embodiment of the invention in which corresponding parts which are identical to those of the FIG. 1 pump are provided with corresponding reference numbers. In the FIG. 7 pump, the excess oil from the cylindrical chamber in housing 10 is returned by way of side wall passage 19 which leads to the crankcase cover adjacent shaft 3 at its extreme lower end. The side wall passage opening prevents interference with the sealing of vanes 6 to the chamber end walls. The lower passage opening surrounding shaft 3 provides some shaft lubrication and allows a compact mounting opening. It should be recognized that the return passage in this embodiment may be located away from shaft 3. In order to provide adequate lubrication for rotation of shaft 3 in bore 15, there is provided a pocket-shaped depression 18 on one end wall of the cylindrical chamber. Depression 18 receives an adequate amount of lubricating oil from slots 14 as the rotor slots pass the depression and conducts the oil to effectively lubricate shaft 3.

A principle advantage of the present invention is that the rotary pump has a rugged and long-lasting design, but is relatively inexpensive to manufacture. As previously noted, the rotor itself is preferably a sintered part press-fitted to a steel shaft. Housing 1 can be similarly cast. Since bearings or seals are not required between shaft 3 and bore 15, assembly of the pump is simplified. The groove 10 or pocket-shaped depression 18 for lubricating shaft 3, which can be cast into the housing, eliminates the potential need for separate lubricating passageways carrying pressurized oil to rotor shaft 3 through housing 1 or through radial holes communicating with an oil delivery passage in the center of shaft 3.

While there have been described what are believed to be the preferred embodiments of the invention, those skilled in the art will recognize that other and further modifications may be made thereto without departing from the true spirit of the invention, and it is intended to claim all such embodiments as fall within the true scope of the invention.

We claim:

1. A rotary pump for producing vacuum pressure comprising an integral housing including a cast member having a cylindrical chamber, a rotor in said chamber having a case-hardened cylindrical shaft pivoted without bearing members in a bore in said cast member parallel and eccentric to said chamber, said rotor having a plurality of vanes mounted slideably in outwardly extending slots of the rotor and resting against the cylindrical walls of said chambers and forming variable volume pump chambers, said vanes being urged against said walls by the pressure of hydraulic oil supplied to said slots behind each of said vanes, a part of said hydraulic oil escaping into said cylindrical chamber and promoting sealing between said vanes and the walls of each cylindrical chamber, and an axially extending groove in said housing along said bore and opening into said cylindrical chamber for the flow off of said escaped oil and for providing said oil to said shaft, wherein said rotor and said vanes have approximately the same axial length as said cylindrical chamber, wherein said housing is provided with a cover axially bounding and sealing said pump chambers from each other, said cover being provided with a suction opening, communicating with one of said pump chambers, and wherein said rotor is provided with a blind hole at its end adjacent said cover, said blind hole permanently communicating with all of said slots and with an oil delivery opening.

2. A rotary pump as specified in claim 1 wherein said rotor is designed for rotation in a selected direction, and wherein the edge of said axially extending groove adjacent said shaft in the direction of said rotation is broken to promote formation of a lubricating oil film between said shaft and said bore.

3. A rotary pump as specified in claim 1 wherein said housing is adapted for mounting directly to an engine crankcase, wherein said shaft projects into said crankcase for connection to an engine shaft and wherein said axially extending groove is arranged to open into said crankcase.

4. A rotary pump as specified in claim 1, wherein said cover is provided with a hydraulic oil delivery opening commutating with said blind hole.

5. A rotary pump as specified in claim 1, wherein said cylinder shaft is provided with an axially extending passage commutating with said blind hole for providing hydraulic oil to said blind hole.

6. A rotary pump as specified in claim 5, wherein said pump is adapted for use in connection with an internal combustion engine, wherein said passage in said shaft communicates with the lubricating system of said engine.

7. A rotary pump as specified in claim 1 wherein said rotor is fabricated of sintered material and has a bore for mounting to said shaft, and wherein said shaft has a knurled section for press-fitting into said rotor.

8. A rotary pump as specified in claim 7 wherein said shaft has a smooth-surface guiding section between said knurled section and one shaft end.

9. A rotary pump for producing vacuum pressure comprising an integral housing including a cast member having a cylindrical chamber, a rotor in said chamber having a case hardened cylindrical shaft pivoted without bearing members in a bore in said cast member parallel and eccentric to said chamber, said rotor having a plurality of vanes mounted slideably in outwardly extending slots of the rotor and resting against the cylindrical walls of said chamber and forming variable volume pumps chambers, and vanes being urged against said walls by the pressure of hydraulic oil supplied to said slots behind each of said vanes, a part of said hydraulic oil escaping into said cylindrical chamber and promoting sealing between said vanes and the walls of said cylindrical chamber, a passage for removal of said escaped oil from said chamber and a pocket-shaped depression at one end of said cylindrical chamber communicating with said bore, for providing said oil to said shaft wherein said rotor and said vanes have approximately the same radial length as said cylindrical chamber, wherein said housing is provided with a cover axially bounding and sealing said pump chambers from each other, said cover being provided with a suction opening communicating with one of said pump chambers and wherein said rotor is provided with a blind hole at its end adjacent said cover, said blind hole permanently communicating with all of said slots and with an oil delivery opening.

10. A rotary pump as specified in claim 9 wherein said passage for removing oil from said cylindrical chamber has an opening at one end in the cylindrical wall of said chamber and an opening at the other end communicating with said bore at the end of said bore away from said cylindrical chamber.

11. A rotary pump as specified in claim 9 wherein said housing is adapted for mounting directly to an engine crankcase, wherein said shaft projects into said crankcase for connection to an engine shaft, and wherein said oil removal passage is arranged to open into said crankcase.

12. A rotary pump as specified in claim 9, wherein said cover is provided with a hydraulic oil delivery opening commutating with said blind hole.

13. A rotary pump as specified in claim 9, wherein said cylinder shaft is provided with an axially extending passage commutating with said blind hole and for providing hydraulic oil to said blind hole.

14. A rotary pump is specified in claim 13 wherein said pump is adapted for use in connection with an internal combustion engine, wherein said passsage in said shaft communicates with the lubricating system of said engine.

15. A rotary pump as specified in claim 9 wherein said rotor is fabricated of sintered material and has a bore for mounting to said shaft, and wherein said shaft has a knurled section for press-fitting into said rotor.

16. A rotary pump as specified in claim 15 wherein said shaft has a smooth-surface guiding section between said knurled section and one shaft end.

* * * * *